United States Patent [19]

Guim et al.

[11] Patent Number: 4,611,201

[45] Date of Patent: Sep. 9, 1986

[54] MAGNETICALLY ACTUATED ILLUMINATING WARNING DEVICE FOR CIRCUIT BREAKERS

[76] Inventors: Raul Guim; Aurelio R. Guim, both of Dade County, Fla.

[21] Appl. No.: 766,266

[22] Filed: Aug. 16, 1985

Related U.S. Application Data

[63] Continuation-in-part of Ser. No. 678,398, Dec. 5, 1984.

[51] Int. Cl.[4] ..... G08B 21/00

[52] U.S. Cl. ..... 340/638; 200/153 G; 200/310; 335/17; 335/205

[58] Field of Search ..... 340/638, 639, 644, 686; 200/310, 313, 315, 316, 317, 81.9 M, 82 E, 83 L, 153 G; 335/17, 205, 207; 116/204, 307

[56] References Cited

U.S. PATENT DOCUMENTS 2,600,309 6/1952 MacDonald et al. ..... 200/81.9 M
3,445,796 5/1969 Spiroch et al. ..... 335/205
4,056,816 11/1977 Guim ..... 340/638

OTHER PUBLICATIONS

IBM Technical Disclosure Bulletin, vol. 4, No. 11, Apr. 1962, p. 19, Toggle Switch by J. W. Berkman.

*Primary Examiner*—James L. Rowland
*Assistant Examiner*—Daniel Myer
*Attorney, Agent, or Firm*—Jesus Sanchelima

[57] ABSTRACT

A magnetically actuated illuminating warning device for conventional circuit breakers of the type that have a switch assembly with three possible positions for its switch lever. A battery powered illuminating device is mounted in the vicinity of the breaker and the illuminating circuit is interrupted by a magnetically actuated switch that is closed when a permanent magnet mounted on the switch lever comes within a predetermined distance. The position of the magnetic switch is selected so that it is actuated or closed when the switch lever is in the overload position.

5 Claims, 3 Drawing Figures

MAGNETICALLY ACTUATED ILLUMINATING WARNING DEVICE FOR CIRCUIT BREAKERS

The present application is a continuation-in-part of U.S. patent application Ser. No. 06/678,398 filed on Dec. 5, 1984, and now pending.

BACKGROUND OF THE INVENTION

1. Field of the Invention

The present invention relates to overload circuit indicators for circuit breakers, and more particularly, to such indicators that are magnetically activated and battery powered.

2. Description of the Prior Art

The need for an illuminated indicator for circuit breakers is quite obvious and it has been documented in several U.S. and foreign patents. In particular, one of the present inventors attempted to solve the problem in U.S. Pat. No. 4,056,816 and the above referenced parent application followed after numerous problems with safety testing agencies (UL, CSA, etc.) because the patented device borrows electricity from the very same source that is being regulated. The device disclosed in the parent application does not take any electricity from the source being regulated but rather it is battery powered and designed to be easily adapted to conventional circuit breakers. The invention in the parent application, however, is susceptible to wear and tear and, more important, it can not be used in flammable atmospheres because the electric contacts activated by the switch lever are exposed. The present invention provides for a device that solves the problem outlined, is more reliable and can be safely operated inside spaces with flammable atmospheres.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a magnetically actuated illuminated device warning for circuit breakers that can be readily installed to existing circuit breakers installations.

It is another object of the present invention to provide such a warning device that is self-powered and does not take any electricity from the source being regulated.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
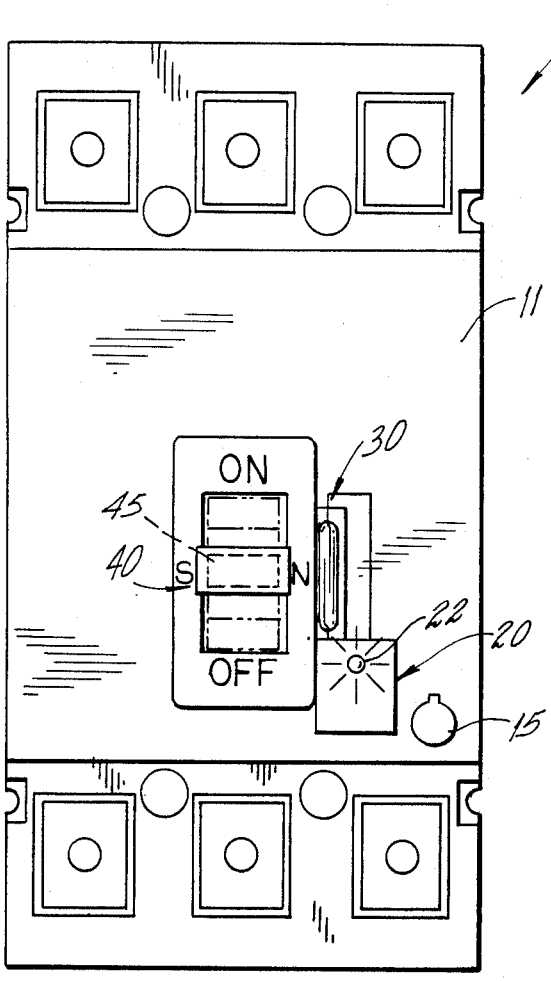
FIG. 1 represents a front view of a conventional circuit breaker including the present invention.
Figure 2:
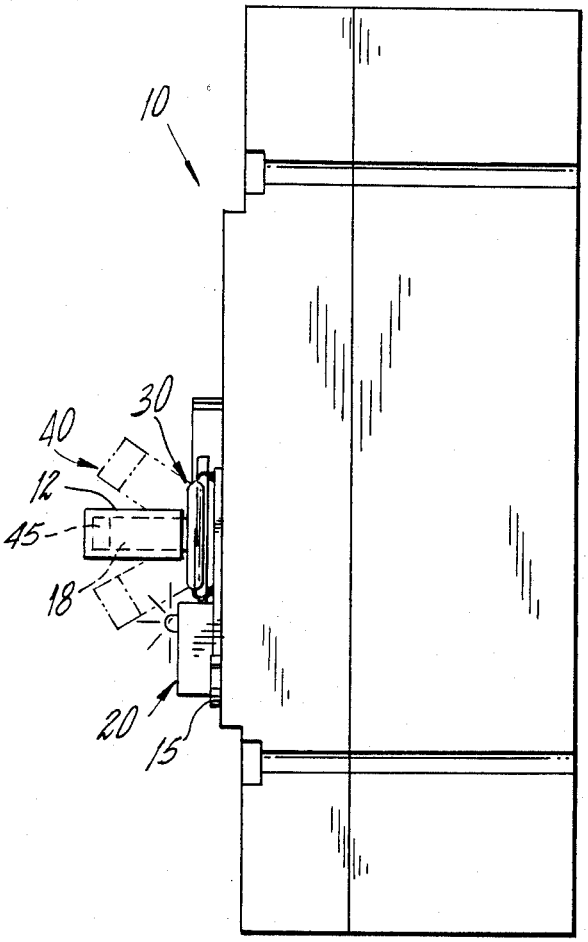
FIG. 2 shows a side view of the breaker represented in FIG. 1.

Referring now to FIGS. 1 and 2, where the improved circuit breaker is generally referred to with numeral 10, it can be observed that it corresponds to a conventional circuit breaker with the addition of illuminated warning device assembly 20, magnetic switch assembly 30 and permanent magnet assembly 40.

Circuit breaker 10 has internally the commonly known mechanism that provides three possible positions for lever 18, namely, ON, OFF and tripped, as illustrated in FIG. 2. Reset 15 brings circuit breaker 10 back to the OFF position from the tripped position.

Figure 3:
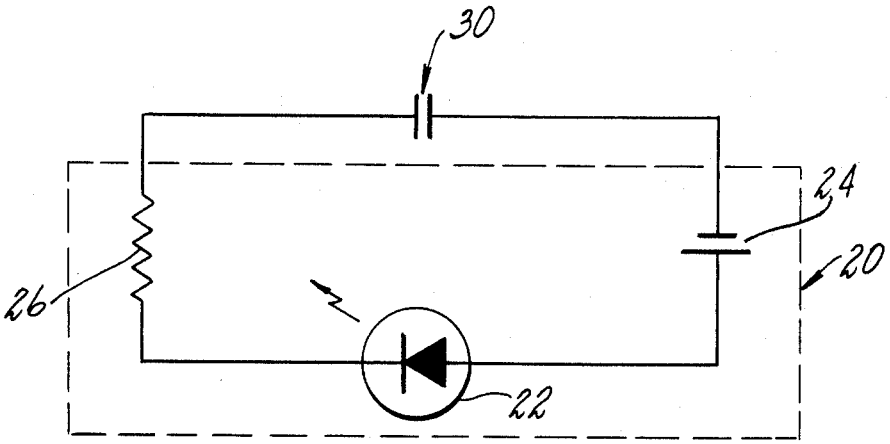
FIG. 3 is a schematic representation of the circuit of the warning device with the magnetic switch and battery.

Illuminated warning device assembly 20 is schematically represented in FIG. 3 and it includes battery element 24, LED element 22 and current limiting resistor 26, all connected in series with magnetic switch assembly 30. Magnetic switch assembly 30 is similar to the ones used for home security alarms to secure openings against intruders. Basically, when a dwelling opening is forced open, the magnetic switch is activated. Switch assembly 30 is normally open and the circuit is closed when permanent magnet assembly 40 comes within a predetermined close distance of switch assembly 30. This causes the switch leaves of assembly 30 to come in contact with each other. Magnetic assembly 40, in the preferred embodiment, consists of magnetic element 45 and sleeve 12 that secures element 45 in position on top of lever 18. The relative position of permanent magnet assembly 40 and switch assembly 30 thus becomes critical and it is to be selected so that switch assembly 30 can only be activated when lever 18 is in the middle which corresponds to the tripped or overload position. The strength of magnetic element 45 is also a factor to be taken into consideration together with the relative position of assembly 30 with respect to assembly 40. Permanent magnet element 45 may be mounted on lever 18 by using a tight bag or sleeve 12, as in the preferred embodiment, or glued to lever 18 or it may be integrally built within lever 18 or lever 18 itself may be magnetized. The last option, of course, being open only to newly manufactured circuit breakers incorporating the present invention. Existing installations will need to mount the present invention to lever 18 and place illuminating warning assembly on a conspicuous place, preferably on the front plate 11 of breaker 10. Button 15 is the conventional reset button found in breakers 10.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. In a circuit breaker of the type that includes a switch assembly having a switch lever with three positions, on, off and overload, the improvement comprising:

A. illuminating warning means, including battery means for powering itself.

B. magnetic switch means in series and normally interrupting the operation of said warning means and said magnetic switch means positioned in the vicinity of said switch lever, and C. permanent magnet means rigidly mounted on said lever and positioned to effectively activate said magnetic switch means when said switch lever is in the overload position.

2. The improvement set forth in claim 1 wherein said illuminating means includes an LED in series with said battery means.

3. The improvement set forth in claim 2 wherein said permanent magnet means include a sleeve member for readily attaching said magnet means to said lever.

4. In a circuit breaker of the type that includes a switch assembly with three possible positions, on, off and overload, the improvement comprising:

A. a magnetized switch lever in said switch assembly;

B. magnetic switch means, of the normally open contacts type, mounted close to said lever and positioned so that said contacts close when said switch lever is in the overload position.

C. illuminating warning means, including battery means for powering itself, and connected in series with said magnetic switch means so that said warning means is activated when said switch lever is in the overload position.

5. The improvement set forth in claim 4 wherein said illuminating warning means includes an LED in series with said battery means.

* * * * *